US008776751B2

(12) United States Patent
Hampton et al.

(10) Patent No.: US 8,776,751 B2
(45) Date of Patent: Jul. 15, 2014

(54) IGNITER INCLUDING A CORONA ENHANCING ELECTRODE TIP

(75) Inventors: Keith Hampton, Ann Arbor, MI (US); William J. Walker, Jr., Toledo, OH (US); James D. Lykowski, Temperance, MI (US)

(73) Assignee: Federal—Mogul Ignition Company, Southfield, MI (US)

( * ) Notice: Subject to any disclaimer, the term of this patent is extended or adjusted under 35 U.S.C. 154(b) by 603 days.

(21) Appl. No.: 13/085,991

(22) Filed: Apr. 13, 2011

(65) Prior Publication Data

US 2011/0247579 A1 Oct. 13, 2011

Related U.S. Application Data

(60) Provisional application No. 61/323,458, filed on Apr. 13, 2010, provisional application No. 61/432,501, filed on Jan. 13, 2011.

(51) Int. Cl.
*F02P 1/00* (2006.01)

(52) U.S. Cl.
USPC ..... 123/143 R; 123/146.5 R

(58) Field of Classification Search
USPC ..... 123/143 R, 146.5, 169 R, 169 EL, 169 E
See application file for complete search history.

(56) References Cited

U.S. PATENT DOCUMENTS

| | | | | |
|---|---|---|---|---|
| 2,320,617 | A | 6/1943 | Landrum | |
| 2,350,731 | A | 6/1944 | Dobrosavijevitch | |
| 2,371,211 | A | 3/1945 | Barrington | |
| 2,871,388 | A | 1/1959 | Adair | |
| 2,906,908 | A | 9/1959 | Marion | |
| 3,119,944 | A | 1/1964 | Lentz et al. | |
| 4,814,665 | A | 3/1989 | Sakura et al. | |
| 4,972,812 | A | 11/1990 | Strumbos | |
| 5,017,826 | A | 5/1991 | Oshima et al. | |
| 5,578,894 | A | 11/1996 | Oshima | |
| 6,225,752 | B1 * | 5/2001 | Matsubara et al. | 315/209 M |
| 7,382,084 | B2 | 6/2008 | Yoshimoto et al. | |
| 7,823,556 | B2 | 11/2010 | Lykowski et al. | |
| 7,847,472 | B2 | 12/2010 | Suzuki et al. | |
| 7,944,134 | B2 | 5/2011 | Kyuno et al. | |

(Continued)

FOREIGN PATENT DOCUMENTS

| | | |
|---|---|---|
| DE | 3616640 | 11/1987 |
| FR | 2 859 831 A1 | 9/2012 |

OTHER PUBLICATIONS

International Search Report PCT/US2012/051553 mailed on Nov. 23, 2012.

*Primary Examiner* — John Kwon
(74) *Attorney, Agent, or Firm* — Robert L. Stearns; Dickinson Wright, PLLC

(57) ABSTRACT

An igniter (20) emitting an electrical field including a plurality of streamers forming a corona includes a corona enhancing tip (52) at an electrode firing end (28). The corona enhancing tip (52) includes an emitting member (58) such as a wire, layer, or sintered mass, formed of a precious metal and disposed on a base member (54). The base member (54) is formed of a nickel alloy. The emitting member (58) has a lower electrical erosion rate and chemical corrosion rate than the base member (54). The emitting member (58) presents the smallest spherical radius of the corona enhancing tip (52) at the outermost radial point (56) to concentrate the electrical field emissions and provide a consistently strong electrical field strength over time.

29 Claims, 16 Drawing Sheets

(56) References Cited

U.S. PATENT DOCUMENTS

| | | | | |
|---|---|---|---|---|
| 2005/0057135 | A1 | 3/2005 | Yoshimoto et al. | |
| 2006/0066194 | A1 | 3/2006 | Morin | |
| 2007/0188063 | A1 | 8/2007 | Lykowski | |
| 2010/0083942 | A1* | 4/2010 | Lykowski et al. | 123/647 |
| 2011/0037370 | A1 | 2/2011 | Ma et al. | |
| 2013/0003251 | A1* | 1/2013 | Durham et al. | 361/253 |

* cited by examiner

IGNITER INCLUDING A CORONA ENHANCING ELECTRODE TIP

CROSS REFERENCE TO RELATED APPLICATION

This application claims the benefit of U.S. Provisional Application Ser. No. 61/323,458, filed Apr. 13, 2010 and U.S. Provisional Application Ser. No. 61/432,501, filed Jan. 13, 2011, the entire contents of which are hereby incorporated by reference.

BACKGROUND OF THE INVENTION

1. Field of the Invention

This invention relates generally to a corona discharge igniter for receiving a voltage from a power source and emitting an electrical field for ionizing and igniting a mixture of fuel and air of an internal combustion engine, and methods of manufacturing the same.

2. Description of Related Art

Igniters of corona discharge air/fuel ignition systems include an electrode received in an insulator and extending longitudinally from an electrode terminal end to an electrode firing end. The electrode terminal end receives a voltage from a power source and the firing end emits an electrical field to ionize and ignite a mixture of fuel and air in a combustion chamber. The electrode typically includes a corona enhancing tip at the firing end, as shown in prior art FIG. 2, for emitting the electrical field. The electrical field includes at least one streamer, and typically a plurality of streamers that form a corona. The corona igniter does not include any grounded electrode element in close proximity to the corona enhancing tip. Rather, the mixture of air and fuel is ignited along the entire length of the high electrical field generated from the corona enhancing tip.

The corona enhancing tip is typically formed of a base material including nickel. The corona enhancing tip typically includes branches each extending from a platform to a distal end, as shown in FIGS. 2-2B. The corona enhancing tip includes an exposed outer surface presenting radius features, such as spherical radii, along the edges and at the distal ends of each branch. As shown in FIGS. 2-2B, the electrical field emitted by the corona enhancing tip is concentrated at the sharpest point or points of the exposed outer surface, i.e. the smallest radius feature or spherical radius. As shown in FIG. 22, the smaller the spherical radius, the stronger the electrical field emitted by the corona enhancing tip. The corona enhancing tip also has a diameter extending between opposite distal ends. As shown in FIG. 23, the diameter of the corona enhancing tip is directly related to the strength of the electrical field.

As shown in FIGS. 2, 2A, and 2B, the corona enhancing tip is typically designed to include the smallest spherical radii at the distal ends of the branches so that the electric field is concentrated and of sufficient strength. However, during use of the electrode in the internal combustion engine, the voltage received by the corona enhancing tip over time causes electrical erosion of the corona enhancing tip. In addition, the corona enhancing tip experiences oxidation or chemical corrosion due to the extreme temperatures, pressures, and constituents of the combustion chamber. As shown in FIGS. 3, 3A, and 3B, the electrical erosion and chemical corrosion causes the corona enhancing tip to experience a reduction in volume. The spherical radius at the distal ends increases and the diameter of the corona enhancing tip decreases. FIGS. 20 and 21 illustrate how the spherical radius of the conventional corona enhancing tip can increase over time due to the erosion and corrosion. Thus, the strength of the electrical field emitted from the corona enhancing tip decreases and the ignition performance degrades. Further, over time, the spherical radius of the distal ends may become greater than a spherical radius located between the corona enhancing tip and the insulator, the electric field to be emitted from the wrong point or an irregular ignition position, as shown in FIG. 3, and referred to as arcing, which is undesirable in many situations. The arcing and/or irregular ignition position also degrades the quality of ignition of the air-fuel mixture.

SUMMARY OF THE INVENTION

The invention provides an igniter for receiving a voltage from a power source and emitting an electrical field that forms a corona to ionize and ignite a mixture of fuel and air of an internal combustion engine. The igniter includes an electrode having an electrode firing end and including a corona enhancing tip at the electrode firing end. The corona enhancing tip includes an emitting member disposed on a base member. The base member has a first volume and the emitting member has a second volume less than the first volume. The base member is formed of a base material having a first electrical erosion rate and a first corrosion rate. The emitting member is formed of a volume stable material having a second electrical erosion rate that is less than the first electrical erosion rate and a second corrosion rate that is less than the first corrosion rate.

The invention also provides a method of forming an igniter for receiving a voltage from a power source and emitting an electrical field that forms a corona to ionize and ignite a mixture of fuel and air of an internal combustion engine, comprising the steps of: providing a base member of a base material having a first electrical erosion rate and a first corrosion rate and a first volume and disposing an emitting member formed of a volume stable material having a second electrical erosion rate less than the first electrical erosion rate and a second corrosion rate less than the first corrosion rate and a second volume less than the first volume on the base member.

The emitting member of the corona enhancing tip can be designed to include a sharp point or radius feature, such as a small spherical radius, for concentrating and emitting a strong electrical field during use of the igniter in a corona ignition system. Since the volume stable material has a lower electrical erosion rate and a lower corrosion rate than the base material, the emitting member can maintain a small spherical radius over time, while the base material begins to erode and corrode to a greater spherical radius. Therefore, the inventive igniter emits a stronger electrical field than the conventional igniter when used in an internal combustion engine for the same amount of time. Also, since the emitting member erodes and corrodes at a lower rate, the inventive igniter provides a more consistent electrical field strength over time compared to the conventional igniter. Thus, the inventive igniter provides a higher quality ignition and better, more stable performance than the conventional igniter over the life of the igniter.

In addition, the igniter of the present invention emits a stronger electrical field than the conventional igniter at the same voltage. The igniter of the invention emits a stronger electrical field at 30 volts than the conventional igniter does at 50 volts. Thus, the inventive igniter is more efficient and provides significant energy cost savings relative to the conventional igniter.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE ENABLING EMBODIMENTS

Figure 1:
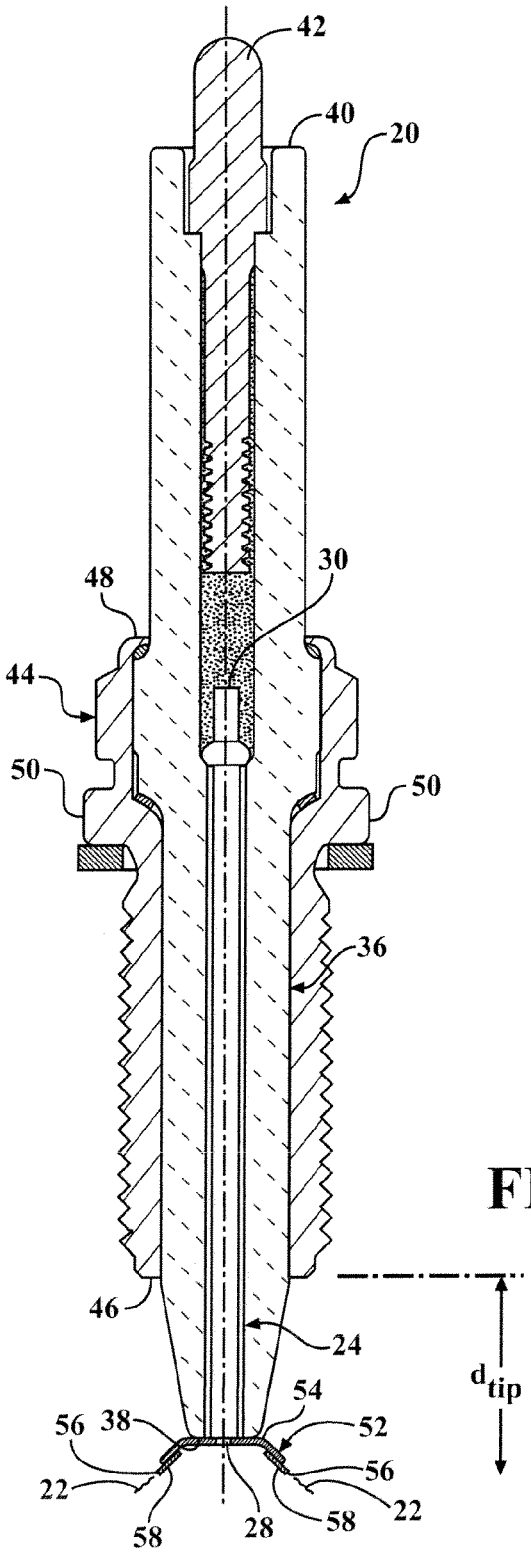
FIG. 1 is a cross-sectional view of an igniter in accordance with one aspect of the invention.
Figure 2:
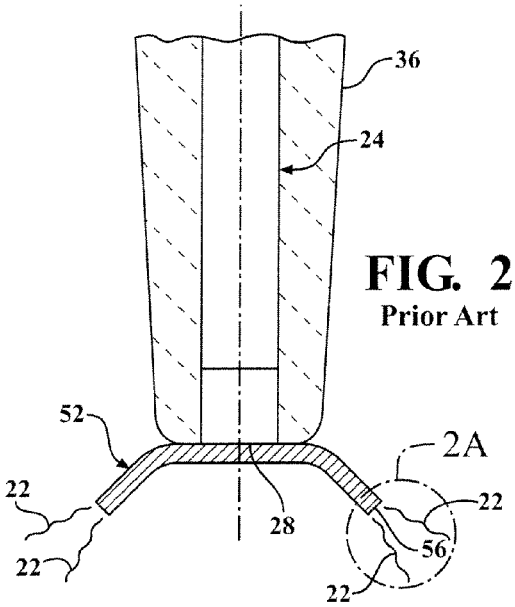
FIG. 2 Prior Art
FIG. 2 is a cross-sectional view of a portion of a conventional igniter before use in an internal combustion engine.
Figure 3:
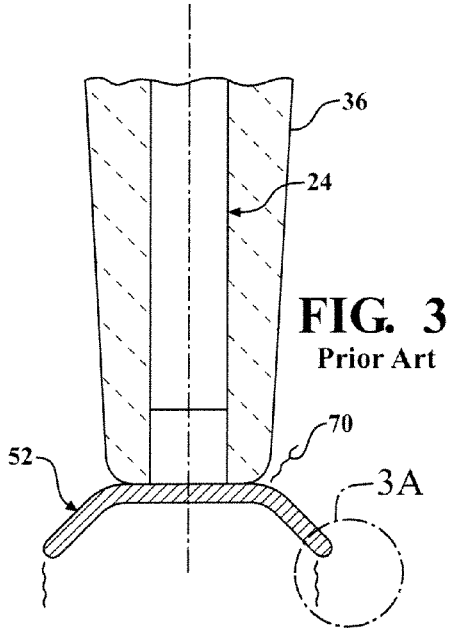
FIG. 3 Prior Art
FIG. 3 is a cross-sectional view of the conventional igniter of FIG. 2 after use in an internal combustion engine.
Figure 2A:
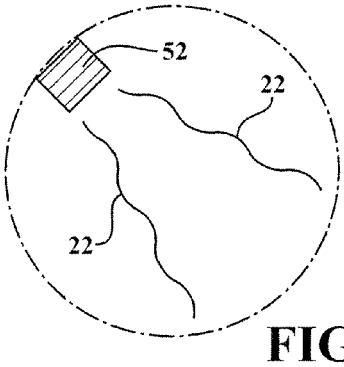
FIG. 2A Prior Art
FIG. 2A is an enlarged view of a tip of the igniter of FIG. 2.
Figure 3A:
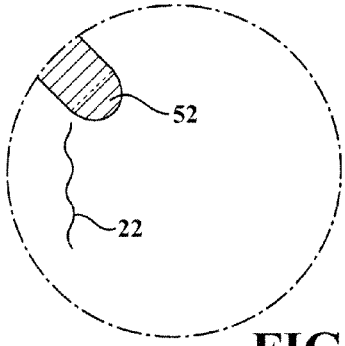
FIG. 3A Prior Art
FIG. 3A is an enlarged view of the tip of the igniter of FIG. 3.
Figure 2B:
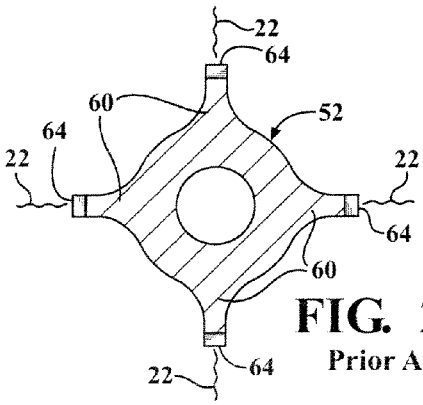
FIG. 2B Prior Art
FIG. 2B is a bottom view of the tip of the igniter of FIG. 2.
Figure 3B:
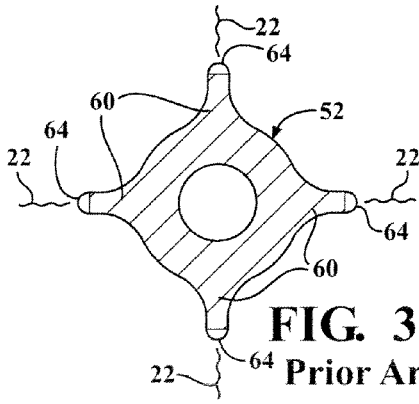
FIG. 3B Prior Art
FIG. 3B is a bottom view of the tip of the igniter of FIG. 3.
Figure 4:
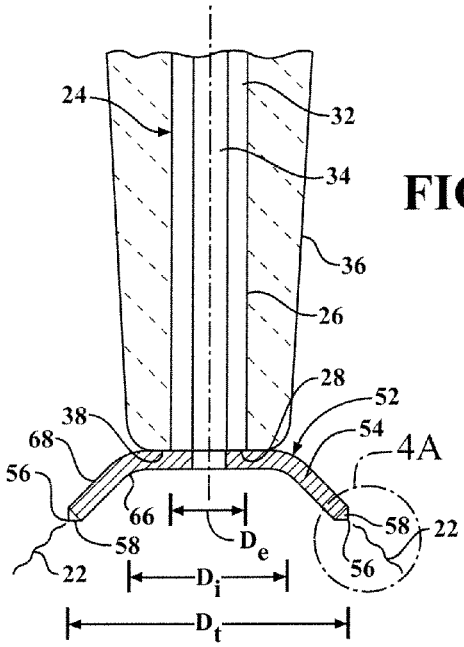
FIG. 4 is a cross-sectional view of a portion of an igniter including a corona enhancing tip in accordance with one embodiment the invention before use in an internal combustion engine.
Figure 4A:
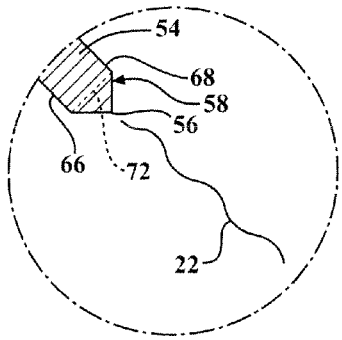
FIG. 4A is an enlarged view of the corona enhancing tip of FIG. 4 along an x-axis.
Figure 4B:
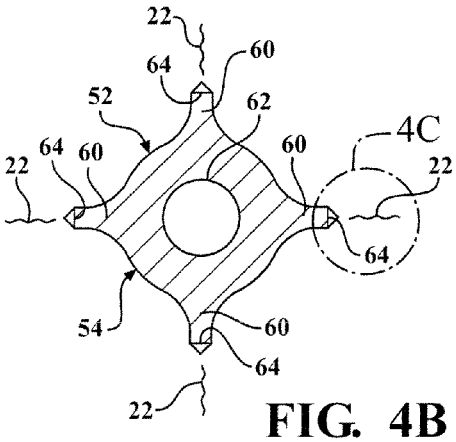
FIG. 4B is a bottom view of the corona enhancing tip of FIG. 4.
Figure 4C:
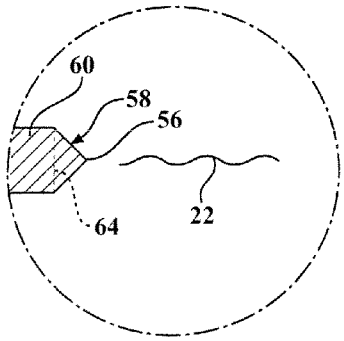
FIG. 4C is an enlarged view of the corona enhancing tip of FIG. 4 along a y-axis.

A corona ignition system includes an igniter 20, as shown in FIG. 1. The igniter 20 receives a voltage from a power source (not shown) and emits an electrical field that forms a corona to ionize and ignite a mixture of fuel and air of a combustion chamber. The electrical field includes at least one streamer 22, as shown in FIG. 1. The mixture of fuel and air ignites along the entire length of the electrical field. The igniter 20 includes an electrode 24 having a body portion 26 extending longitudinally from an electrode firing end 28 to an electrode terminal end 30. The body portion 26 of the electrode 24 can include a bulk portion 32 and a core 34, wherein the core 34 has a heat transfer coefficient greater than the heat transfer coefficient of the bulk portion 32. For example, the bulk portion 32 can be formed of a nickel alloy and the core 34 can be formed of copper. The body portion 26 of the electrode 24 has an electrode diameter $D_e$ extending generally perpendicular to the longitudinal body portion 26 of the electrode 24, as shown in FIG. 4.

An insulator 36 surrounds the body portion 26 and extends longitudinally along the body portion 26 from an insulator nose end 38 to an insulator upper end 40. The insulator nose end 38 is adjacent the electrode firing end 28. The insulator 36 has an insulator diameter $D_i$ at the insulator nose end 38 extending generally perpendicular to the longitudinal body portion 26 of the electrode 24, as shown in FIG. 4.

The igniter 20 typically includes a terminal 42 in electrical communication with the electrode 24 and a connecting wire (not shown). The connecting wire is in electrical communication with a power source (not shown) supplying the voltage. The terminal 42 is disposed at the electrode terminal end 30, received in the insulator 36, and extends outwardly of the insulator upper end 40. The terminal 42 receives the voltage from the connecting wire and conveys the voltage to the electrode terminal end 30.

A shell 44 formed of a metal material surrounds the insulator 36 and extends along a portion of the insulator 36 from a lower shell end 46 to an upper shell end 48 such that the insulator nose end 38 projects outwardly of the lower shell end 46. The shell 44 includes external flanges 50 extending outwardly between the shell ends 46, 48. The ignition system can include a tube (not shown) engaging the shell 44 and surrounding the upper shell end 48 for retaining the shell 44 in a predetermined position in the ignition system. The ignition system can also include other components typically found in corona ignition systems.

As shown in FIGS. 4-19, the electrode 24 of the igniter 20 includes a corona enhancing tip 52 at the electrode firing end 28 of the electrode 24. The voltage received from the power source travels to the corona enhancing tip 52, which in turn emits the electrical field that forms a corona to ionize the mixture of fuel and air in the combustion chamber. The corona enhancing tip 52 is disposed outwardly of the insulator nose end 38. A tip distance $d_{tip}$ between the lower shell end 46 and the base member 54 of the corona enhancing tip 52, as shown in FIG. 1, is minimized to concentrate the electrical field emitted by the insulator 36 at the corona enhancing tip 52. The corona enhancing tip 52 has a tip diameter $D_t$ extending generally perpendicular to the longitudinal body portion 26 of the electrode 24. As shown in FIG. 4, the tip diameter $D_t$ is greater than the electrode diameter $D_e$ and the insulator diameter $D_i$.

Figure 15:
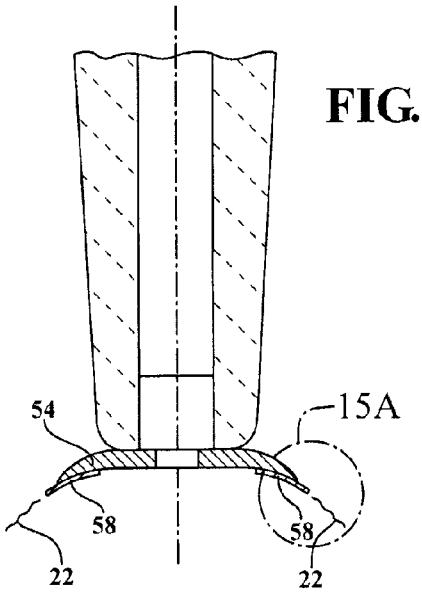
FIG. 15 cross-sectional view of a portion of the igniter of FIG. 14 after use in an internal combustion engine.
Figure 15A:
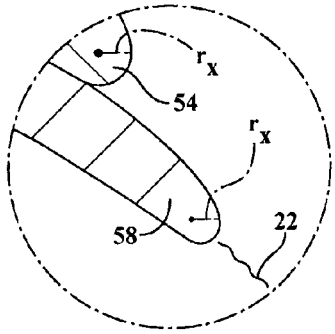
FIG. 15A is an enlarged view of the corona enhancing tip of FIG. 15 along an x-axis.
Figure 15C:
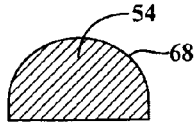
FIG. 15C is a cross-sectional side view taken along line 15C of FIG. 15B.
Figure 15B:
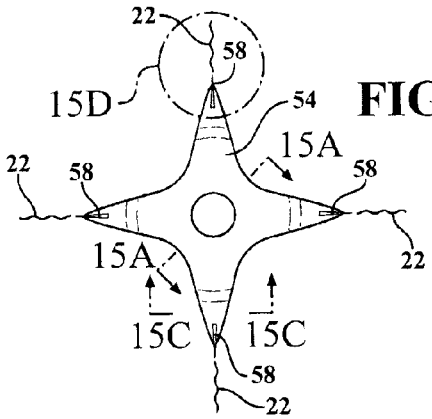
FIG. 15B is a bottom view of the corona enhancing tip of FIG. 15.
Figure 15D:
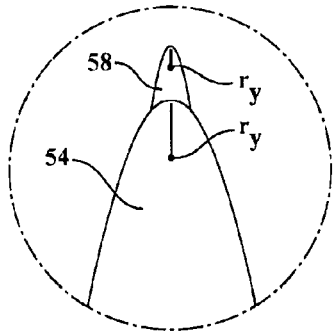
FIG. 15D is an enlarged view of the corona enhancing tip of FIG. 15 taken along a y-axis.
Figure 15E:
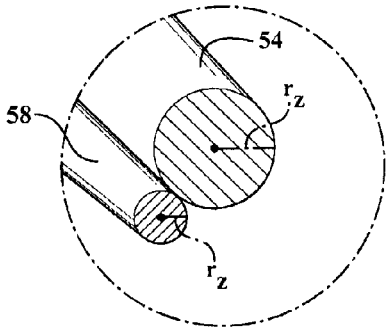
FIG. 15E is an enlarged view of the corona enhancing tip of FIG. 15 taken along a z-axis.
Figure 23:
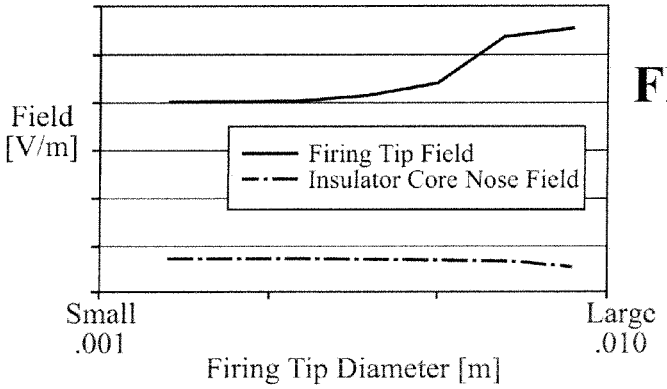
FIG. 23 is a graph showing a relationship between a diameter of a corona enhancing tip and electric field strength of a corona emitted from the corona enhancing tip.

As shown in FIG. 23, the tip diameter $D_t$ is directly related to the strength of the electrical field emitted by the corona enhancing tip 52. A greater tip diameter $D_t$ provides a greater electrical field strength. The corona enhancing tip 52 includes an outer surface presenting radius features, such as spherical radii, at points along the outer surface. The spherical radius at a particular point is obtained from a sphere having a radius at that particular point. The spherical radius is the radius of the sphere in three-dimensions, specifically along an x-axis, a y-axis, and a z-axis ($r_x$, $r_y$, $r_z$). FIGS. 15A, 15D, and 15E provide an example of a spherical radius at two particular points of the corona enhancing tip 52.

The spherical radius of the corona enhancing tip 52 located at the outermost radial point 56 of the corona enhancing tip 52 is preferably the smallest spherical radius of the corona enhancing tip 52, and the spherical radius at the outermost radial point 56 is preferably as small as possible, so that the electrical field emission is concentrated at that point. As shown in FIGS. 4, 4A, 4B, and 4C, the outermost radial point 56 of the corona enhancing tip 52 is the point on the corona enhancing tip 52 farthest from the center of the corona enhancing tip 52 in a radial direction. The corona enhancing tip 52 may include one or more than one outermost radial point 56, and at least one of those points has the smallest spherical radius of the corona enhancing tip 52. For example, as shown in FIGS. 4, 4A, 4B, and 4C, the corona enhancing tip 52 includes four points equally distant and farthest from the center, having a spherical radius, which is smaller than every other spherical radius at the outer surface of the corona enhancing tip 52.

The corona enhancing tip 52 includes a base member 54 and an emitting member 58, as shown in FIGS. 4-19. The base member 54 and the emitting member 58 each present at an outer surface being exposed. The outer surface of the emitting member 58 and base member 54 both present at least one spherical radius. Preferably, at least one of the spherical radii of the exposed outer surface of the emitting member 58 is smaller than each of the spherical radii at the exposed outer surface of the base member 54 so that the electrical field is emitted from the emitting member 58 and not from the base member 54.

The base member 54 is formed of a base material having a first electrical erosion rate and a first chemical corrosion rate. The first erosion rate and the first corrosion rate of the base material can be measured according to a variety of methods known in the art. The base material has melting point, thermal conductivity, and other properties that effect the first electrical erosion rate and the first corrosion rate. In one embodiment, the base material has a melting point of 1,430° C. to 1,570° C.

The base material has a ductility such that the material can be machined and formed into a variety of shapes. For example, the base material can be selected from the group consisting of nickel, nickel alloy, copper, copper alloy, iron, and iron alloy. In one embodiment, the base material has a ductility of 0.02 to 0.06, preferably at least 0.04, and more preferably at least 0.05, according to S.I. units of measurement.

The base member 54 can also include a core 34 formed of a material different from the base material for transferring the heat transfer away from the base material. The core 34 typically has a heat transfer coefficient greater than the heat transfer coefficient of the base material. In one embodiment, the base material is a nickel alloy and the core 34 is a copper.

Figure 6:
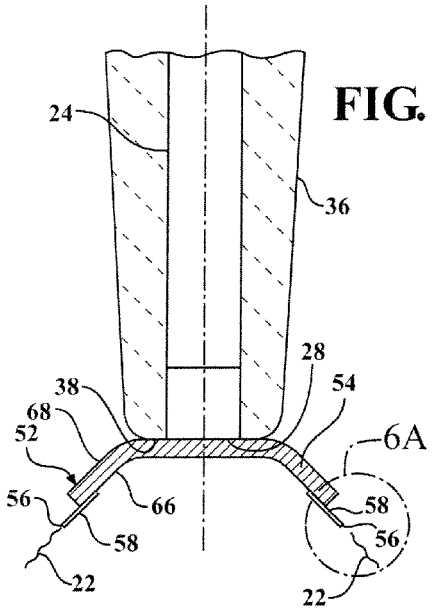
FIG. 6 is a cross-sectional view of a portion of an igniter including a corona enhancing tip in accordance with another embodiment the invention before use in an internal combustion engine.
Figure 6A:
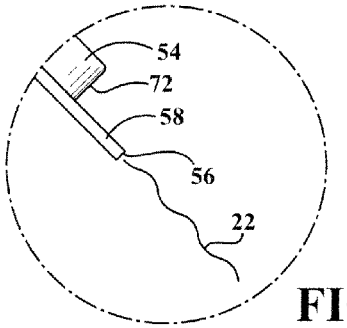
FIG. 6A is an enlarged view of the corona enhancing tip of FIG. 6.
Figure 6B:
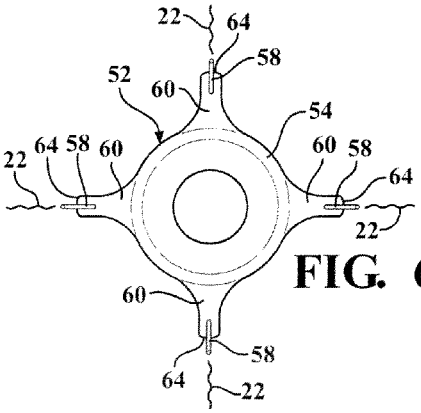
FIG. 6B is a bottom view of the corona enhancing tip of FIG. 6.
Figure 10:
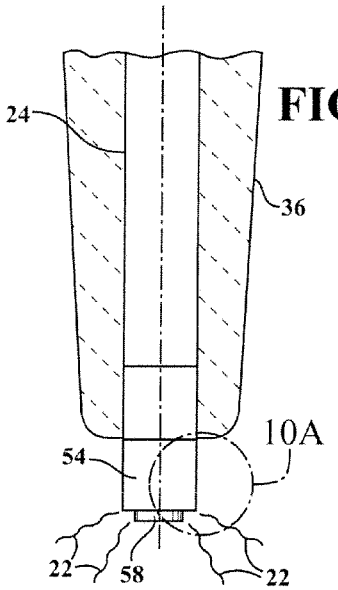
FIG. 10 is a cross-sectional view of a portion of an igniter including a corona enhancing tip in accordance with another embodiment the invention before use in an internal combustion engine.
Figure 10A:
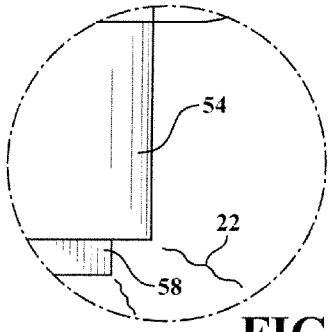
FIG. 10A is an enlarged view of the corona enhancing tip of FIG. 10.
Figure 10B:
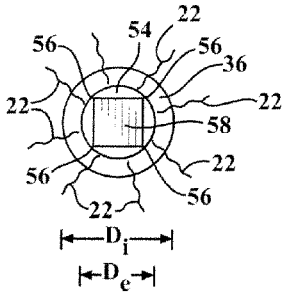
FIG. 10B is a bottom view of the corona enhancing tip of FIG. 10.

The base member 54 is formed to a first volume and is typically fowled into a shape comprising a plurality of branches 60 extending from a platform 62 to distal ends 64, as shown in FIGS. 6, 6A, and 6B. However, the base member 54 can be formed into other shapes without branches 60, such as a generally rectangular block, as shown in FIGS. 10, 10A, and 10B. The base member 54 presents a firing surface 66 typically facing outwardly of the insulator 36 and an oppositely facing arcing surface 68 facing toward the insulator 36, as shown in FIGS. 6, 6A, and 6B. A portion of the arcing surface 68 and the firing surface 66 are an outer surface exposed to the mixture of air and fuel in the combustion chamber. The base member 54 also includes an interior surface abutting another element or a few other elements and thus being unexposed to the mixture in the combustion chamber. The base member 54 typically abuts a portion of the insulator 36, the electrode firing end 28, and the emitting member 58.

The branches 60 of the base member 54 preferably extend outwardly and at an angle from the platform 62 to the distal ends 64. The branches 60 are preferably formed at an angle of about 15 degrees to about 60 degrees relative to the platform 62, away from the insulator 36. The base member 54 typically includes four branches 60 equally distant from one another, wherein each branch 60 is symmetric to an opposite branch 60. Alternatively, the base member 54 can include another number of branches 60, and the branches 60 can be formed planar, non-symmetric, or at other angles relative to the platform 62 and one another.

The branches 60 each include the firing surface 66 and the oppositely facing arcing surface 68, as shown in FIGS. 6, 6A, and 6B. The emitting member 58 is typically disposed on or along the firing surface 66 of the branches 60, but could be disposed on the arcing surface 68. As shown in FIGS. 12C, 13C, 14C, 15C, 16C, and 17C, the arcing surface 68 of the branches 60 can be intentionally formed to present a large spherical radius, preferably a round, convex profile, to prevent electrical field emissions off the arcing surface 68, i.e. to prevent arcing 70.

In one embodiment, as shown in FIG. 4, the branches 60 of the base member 54 include a transition surface 72 interconnecting the firing surface 66 and the arcing surface 68 at the distal ends 64. In that embodiment, the transition surface 72 is blunt and the emitting member 58 can be disposed on the transition surface 72.

Figure 12:
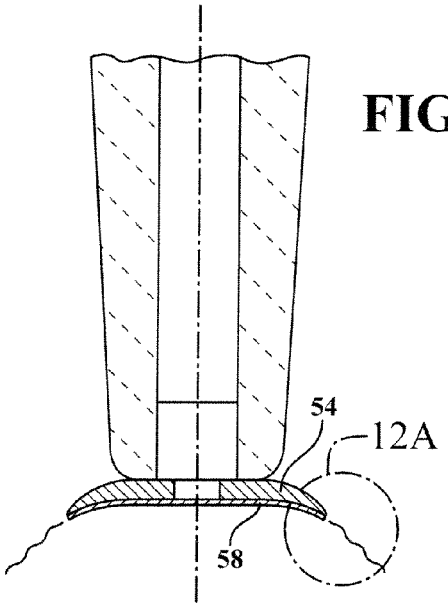
FIG. 12 is a cross-sectional view of a portion of an igniter including a corona enhancing tip in accordance with another embodiment the invention before use in an internal combustion engine.
Figure 12A:
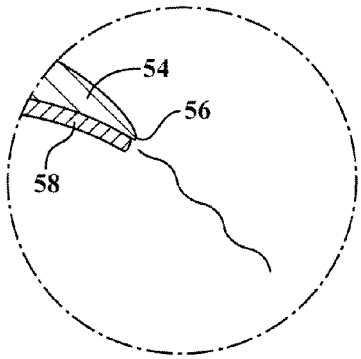
FIG. 12A is an enlarged view of the corona enhancing tip of FIG. 12.
Figure 12B:
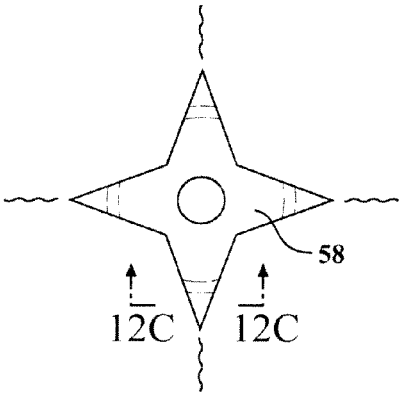
FIG. 12B is a bottom view of the corona enhancing tip of FIG. 12.
Figure 12C:
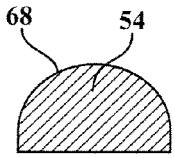
FIG. 12C is a cross-sectional side view taken along line 12C of FIG. 12B.

In another embodiment, as shown in FIG. 12, the branches 60 are tapered to the distal ends 64. The tapered branches 60 provide advantages over the non-tapered branches 60, including more effective heat transfer out of the base material. The tapered branches 60 also concentrate the electrical field toward the distal ends 64 of the branches 60 more effectively than the non-tapered branches 60. In one embodiment, the spherical radius presented at the distal ends 64 is not greater than 0.18 millimeters, preferably not greater than 0.13 millimeters, and more preferably not greater than 0.08 millimeters, such as 0.02 millimeters to 0.08 millimeters.

The base member 54 including the branches 60 is typically formed from a sheet or disk of the base material. In the embodiment shown in FIG. 4, the base member 54 can be formed from a sheet having a thickness of about 0.4 to 0.6 millimeters. A shape comprising four of the branches 60 extending outwardly from the platform 62 to the distal ends 64 is stamped from the sheet of base material. Each branch 60 is disposed symmetric to another one of the branches 60. The distal ends 64 of opposite branches 60 are spaced from one another by about 5 millimeters. Next, each of the branches 60 are bent to a predetermined angle, such as a 45 degree angle, so that the distal ends 64 are spaced from one another by about 4.7 millimeters. The branches 60 can be formed to the 45 degree angle in a molding press or by another method known in the art.

In another embodiment shown in FIG. 12, the base member 54 is formed from a disc having a thickness of about 0.4 to 0.6 millimeters and a radius of about 2.5 to 3 millimeters, for example. Next, a surface of the disc, such as the firing surface 66, is tapered to the edges of the disc. In one preferred embodiment, the edges of the disc have a spherical radius of not greater than 0.08 millimeters. A shape comprising the branches 60 extending outwardly from the platform 62 to the distal ends 64 is then stamped from the tapered disc. Each branch 60 is disposed symmetric to another one of the branches 60. Each branch 60 is also tapered to the distal ends 64 and has a spherical radius of not greater than 0.08 millimeters. Next, a portion of each branch 60 adjacent the distal ends 64 is bent to an angle of about 30 to 50 degrees so that the distal ends are about 1 millimeter below the platform 62 of the base member 54.

As stated above, once the base member 54 is provided, the emitting member 58 of the corona enhancing tip 52 is disposed on the base member 54. The voltage received by the terminal 42 is transferred to the emitting member 58 of the electrode 24, which in turn emits an electrical field that forms a corona to ionize and ignite the mixture of fuel and air in the combustion chamber. The emitting member 58 is formed of a volume stable material having a second electrical erosion rate being less than the first electrical erosion rate and a second corrosion rate being less than the first corrosion rate. The emitting member 58 is more resistant to electrical erosion and chemical corrosion than the base member 54, and thus the emitting member 58 does not wear away as quickly as the base member 54.

The emitting member 58 preferably presents a spherical radius that is less than each radius feature or spherical radius presented by the base member 54. The smallest spherical radius is preferably located at the outermost radial point 56 of the corona enhancing tip 52, which is preferably provided by the emitting member 58. FIGS. 15A, 15D, and 15E illustrate an example of radii ($r_x$, $r_y$, $r_z$) of the emitting member 58 and the base member 54 in three dimensions, along an x-axis, a y-axis, and a z-axis. Since the emitting member 58 is formed of the volume stable material that has a lower erosion and corrosion rate, the spherical radius of the emitting member 58 increases at a lower rate than each of the spherical radii of the base member 54 during use of the igniter 20 in the internal combustion engine.

Further, the second volume of the emitting member 58 decreases at a lower rate than the first volume of the base member 54. The emitting member 58 preferably experiences little, if any, reduction in volume during use in the internal combustion engine. Thus, the emitting member 58 stays sharp and emits a consistently strong electrical field over a period of time, compared to the conventional igniter tips that wear away and emits a weaker electrical field over time.

The second erosion rate and the second corrosion rate of the volume stable material can be measured according to a variety of methods known in the art. The volume stable material has a melting point, thermal conductivity, and other properties that effect the second electrical erosion rate and the second chemical corrosion rate. The melting point and thermal conductivity of the volume stable material is typically greater than the melting point and the thermal conductivity of the base material. In one embodiment, the volume stable material has a melting point of at least 1,500° C. The volume stable material is also more resistant to the extreme temperatures, pressures, and constituents present in the combustion chamber, such as sulfur, phosphorus, calcium, and oxygen. Preferably, the volume stable material has no volatile oxidation states at normal operating temperatures of the internal combustion engine.

The volume stable material typically comprises elements referred to as precious metals or precious metal alloys, such as elements selected from Groups 4-12 of the Periodic Table of the Elements. In one embodiment, the volume stable material is selected from the group consisting of platinum, platinum alloys, iridium, and iridium alloys. The volume stable material could also include tungsten, nickel alloy, or a conductive ceramic having an electrical erosion rate and corrosion rate less than the base material.

The emitting member 58 is formed to a second volume that is less than the first volume of the base member 54 and to present a smaller spherical radius. As shown in the Figures, the emitting member 58 is preferably formed into a wire, a layer, or a sintered mass of the volume stable material. However, the emitting member 58 can be formed into other shapes, such as a generally rectangular block, as shown in FIGS. 10, 10A, 10B, 16A, and 16B. The emitting member 58 can be disposed on and attached to the base member 54 according to a variety of methods known in the art, such as traditional sintering, laser sintering, plating, sputtering, pressing, molding, or welding.

The emitting member 58 includes a firing surface 66 typically facing outwardly and downwardly of the insulator 36. The firing surface 66 is an outer surface exposed to the mixture of air and fuel of the combustion chamber. As stated above, the emitting member 58 includes spherical radii at that exposed outer surface. Preferably, the smallest spherical radius is located at the outermost radial point 56 of the exposed outer surface and is not greater than 0.2 millimeters, so that the emitting member 58 emits a consistently strong electrical field over time. A variety of methods can be used to form the emitting member 58 to include a spherical radius at the exposed outer surface that is less than each spherical radius of the base member 54.

The emitting member 58 also includes an interior surface abutting another element, specifically the base member 54, and thus is unexposed to the mixture of the combustion chamber. The emitting member 58 is typically disposed on the firing surface 66 of the base member 54. Alternatively, the emitting member 58 could be disposed on the arcing surface 68 of the base member 54, in situations where arcing 70 is desired.

Figure 8:
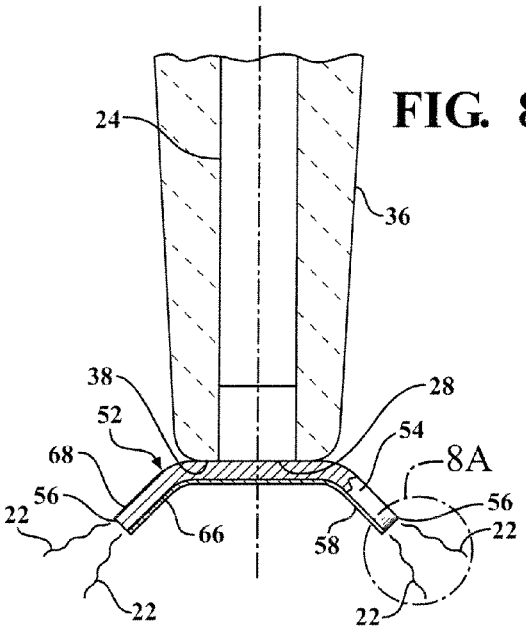
FIG. 8 is a cross-sectional view of a portion of an igniter including a corona enhancing tip in accordance with another embodiment the invention before use in an internal combustion engine.
Figure 9:
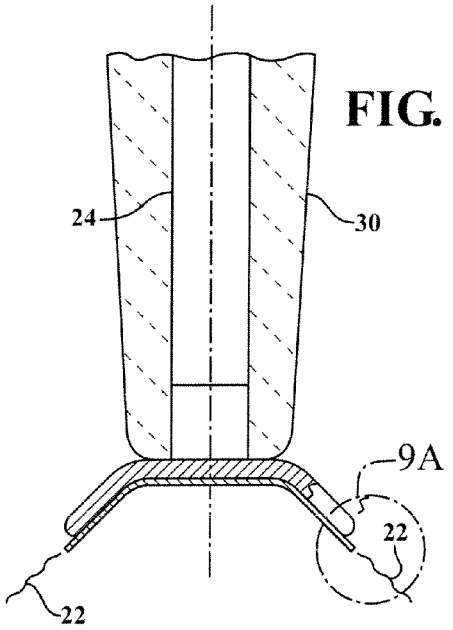
FIG. 9 is a cross-sectional view of the igniter of FIG. 8 after use in an internal combustion engine.
Figure 13:
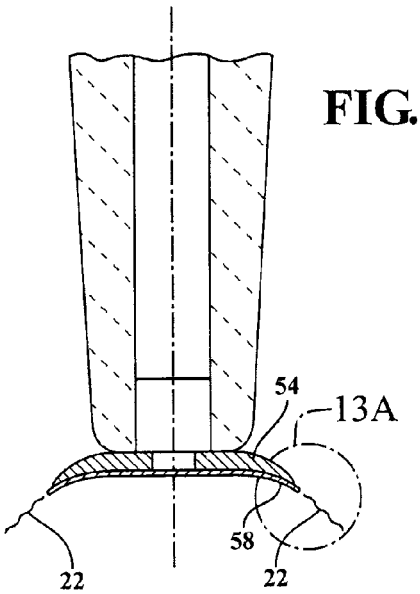
FIG. 13 cross-sectional view of the igniter of FIG. 12 after use in an internal combustion engine.
Figure 13A:
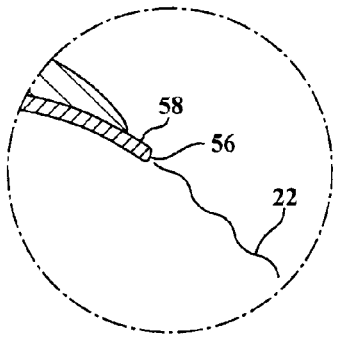
FIG. 13A is an enlarged view of the corona enhancing tip of FIG. 13 along an x-axis.
Figure 13B:
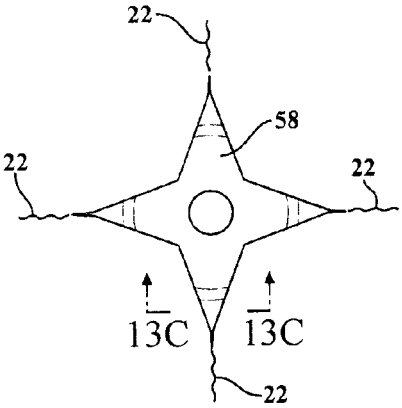
FIG. 13B is a bottom view of the corona enhancing tip of FIG. 13.
Figure 13C:
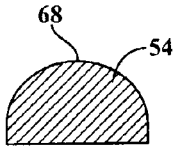
FIG. 13C is a cross-sectional side view taken along line 13C of FIG. 13B.

In the embodiments of FIGS. 8, 8A, 8B, 12A, and 12B, the emitting member 58 is provided as a layer disposed on and along base member 54. The layer can be applied to the entire firing surface 66, or a portion of the firing surface 66 of the base member 54. The layer is typically deposited on the base member 54 in the form of powder metal. The powder of the volume stable material can be applied by sputtering or other methods known in the art. The layer could also be applied by plating or by pressing a sheet of the volume stable material on the base member 54. FIGS. 9, 9A, and 9B illustrate the spherical radius of the emitting member 58 of FIGS. 8, 8A, and 8B experiences little to no change after use in the internal combustion engine. FIGS. 13, 13A, and 13B, illustrate the spherical radius at the outermost radial point 56 of the emitting member 58 of FIGS. 12, 12A, and 12B experiences little to no change after use in the internal combustion engine.

Figure 8A:
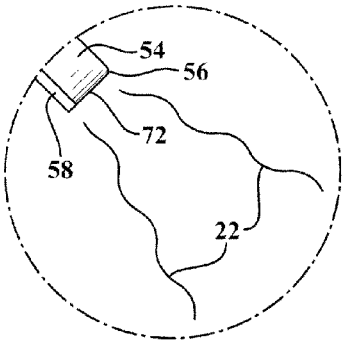
FIG. 8A is an enlarged view of the corona enhancing tip of FIG. 8.
Figure 9A:
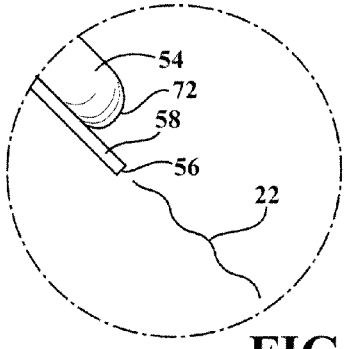
FIG. 9A is an enlarged view of the corona enhancing tip of FIG. 9 along an x-axis.
Figure 8B:
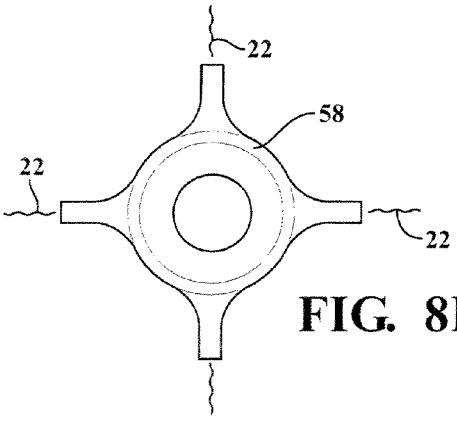
FIG. 8B is a bottom view of the corona enhancing tip of FIG. 8.
Figure 9B:
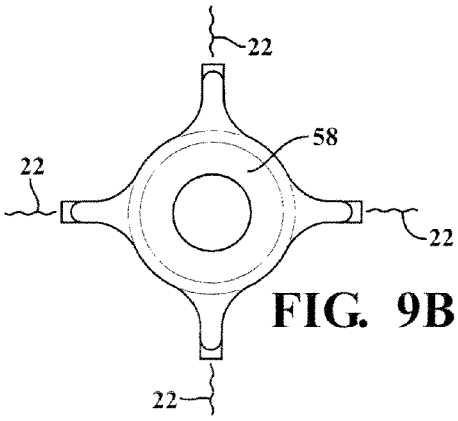
FIG. 9B is a bottom view of the corona enhancing tip of FIG. 9.

As shown in FIG. 8A, the edges of the layer are preferably aligned with the distal ends 64 of the base member 54. The edges of the layer can provide the smallest spherical radius at the outermost radial point 56 of the corona enhancing tip 52 for emitting a strong electrical field. When the base member 54 has a thickness of 0.4 to 0.5 millimeters, the layer typically has a thickness of not greater than 0.1 millimeters. Although not shown, the edges of the layer can be tapered.

As shown in FIG. 8, before use of the igniter 20 and when first using the igniter 20 in the ignition system, the distal ends 64 of the base member 54 and the outermost radial point 56 provided by the emitting member 58 are both sharp and provide an equally small spherical radius, and thus a strong electrical field is emitted from each of those points. However, as shown in FIG. 9, over time, the base member 54 wears away and the spherical radius of the base member 54 becomes greater than the spherical radius of the emitting member 58. The electric field becomes concentrated to the smaller spherical radius of the emitting member 58, rather than to both the base member 54 and the emitting member 58. Thus, the electric field strength actually increases over time, which is a significant advantage over the prior art.

Figure 7:
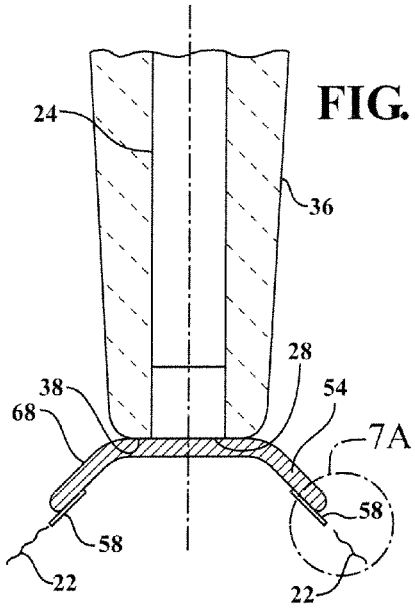
FIG. 7 is a cross-sectional view of a portion of the igniter of FIG. 6 after use in an internal combustion engine.
Figure 7A:
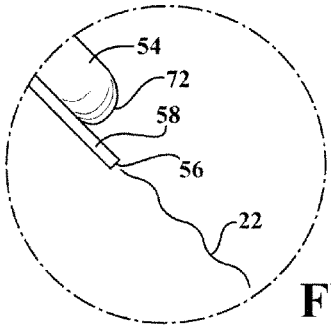
FIG. 7A is an enlarged view of the corona enhancing tip of FIG. 7 along an x-axis.
Figure 7B:
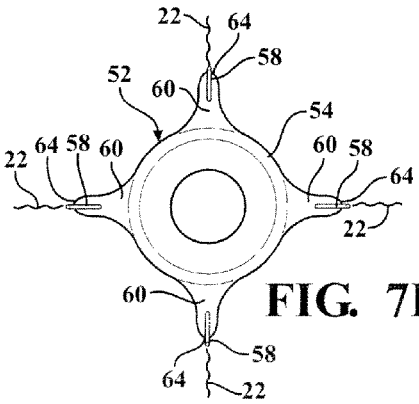
FIG. 7B is a bottom view of the corona enhancing tip of FIG. 7.
Figure 14:
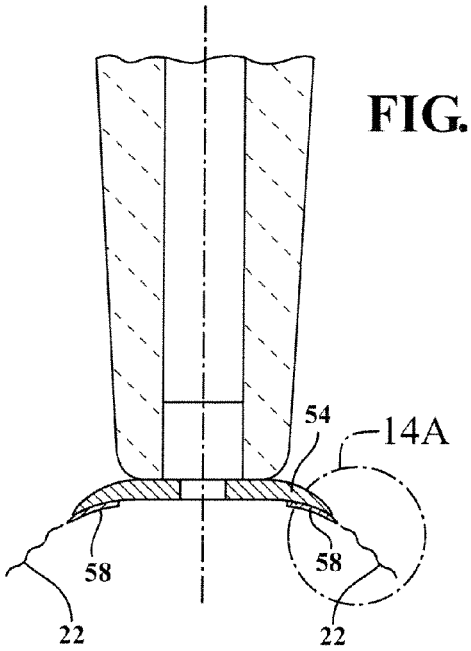
FIG. 14 is a cross-sectional view of a portion of an igniter including a corona enhancing tip in accordance with another embodiment the invention before use in an internal combustion engine.
Figure 14A:
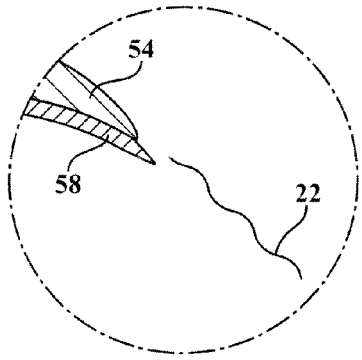
FIG. 14A is an enlarged view of the corona enhancing tip of FIG. 14.
Figure 14B:
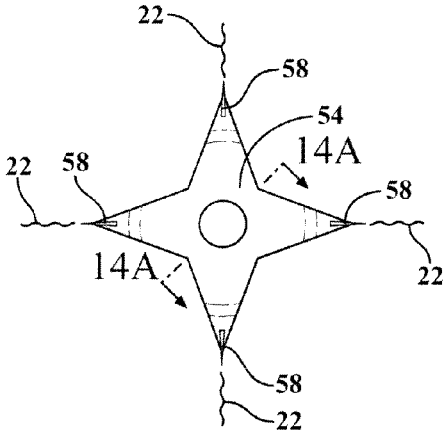
FIG. 14B is a bottom view of the corona enhancing tip of FIG. 14.
Figure 14C:
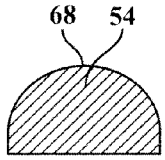
FIG. 14C is a cross-sectional side view taken along line 14C of FIG. 14B.

The emitting member 58 can also be provided as a wire extending between wire ends. The volume stable material is formed into the wire before being disposed on the base member 54. In the embodiments of FIGS. 6, 6A, and 6B, the corona enhancing tip 52 includes blunt distal ends 64 and one of the wires is disposed along each of the branches 60. In the embodiments of FIGS. 14, 14A, and 14B the corona enhancing tip 52 includes the tapered distal ends 64 and one of the wires is disposed along each of the branches 60. Preferably, one of the wire ends extends outwardly of the distal ends 64 of the base member 54 to provide the smallest spherical radius of the corona enhancing tip 52 at the outermost radial point 56 of the corona enhancing tip 52. FIGS. 7, 7A, and 7B, illustrate the spherical radius of the emitting member 58 of FIGS. 6, 6A, and 6B experiences little to no change after use in the internal combustion engine. FIGS. 15, 15A, 15B, 15D, and 15E illustrate spherical radius of the emitting member 58 of FIGS. 14, 14A, and 14B experiences little to no change after use in the internal combustion engine.

The wire can have a generally cylindrical shape or a generally rectangular shape, and can be formed according to a variety of methods known in the art. The wire can be formed to include blunt wire ends as shown in FIG. 6, or can be a tapered to at least one of the wire ends, as shown in FIG. 15. The tapered wire end provides an advantage over the non-tapered end, including a smaller spherical radius at the outermost radial point 56 and more effective heat transfer out of the volume stable material. The tapered end also concentrates the electrical field toward the outermost radial point 56 more effectively than the non-tapered end. In one embodiment, the wire has a diameter of not greater than about 0.2 millimeters, and the tapered wire end has a spherical radius at the outermost radial point 56 of not greater than 0.08 millimeters. The wire is typically attached to the base member 54 by welding.

The emitting member 58 can also be in the form of a sintered powder metal disposed on a portion of the base member 54. In the embodiment of FIGS. 4, 4A, 4B, and 4C, when the base member 54 includes the branches 60 with the blunt distal ends 64, the volume stable material is deposited on the transition surface 72 of the branches 60 in the form of powder metal and then sintered to provide a sintered mass of the volume stable material. Preferably, the mass of volume stable material is laser sintered to a predetermined shape presenting the smallest spherical radius at the outermost radial point 56 of the corona enhancing tip 52. However, the volume stable material can be machined or formed according other methods known in the art. FIGS. 5, 5A, 5B, and 5C illustrate the spherical radius at the outermost radial point 56 of the emitting member 58 of FIGS. 4, 4A, 4B, and 4C experiences little to no change after use in the internal combustion engine.

Figure 18:
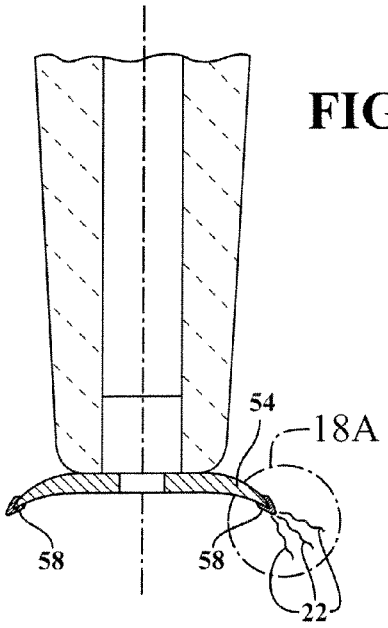
FIG. 18 is a cross-sectional view of a portion of an igniter including a corona enhancing tip in accordance with another embodiment the invention before use in an internal combustion engine.
Figure 18A:
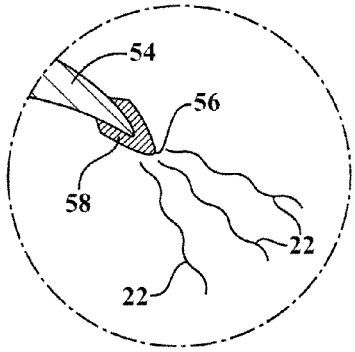
FIG. 18A is an enlarged view of the corona enhancing tip of FIG. 18.
Figure 18B:
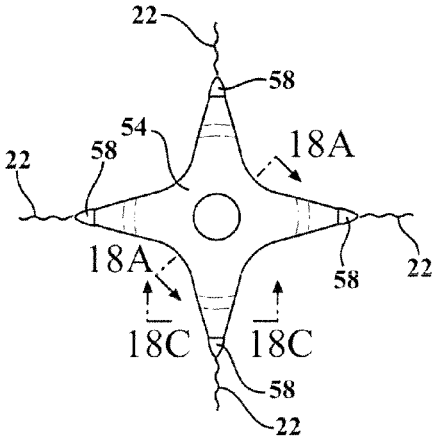
FIG. 18B is a bottom view of the corona enhancing tip of FIG. 18.
Figure 18C:
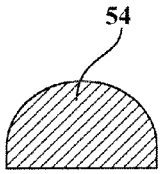
FIG. 18C is a cross-sectional side view taken along line 18C of FIG. 18B.
Figure 19:
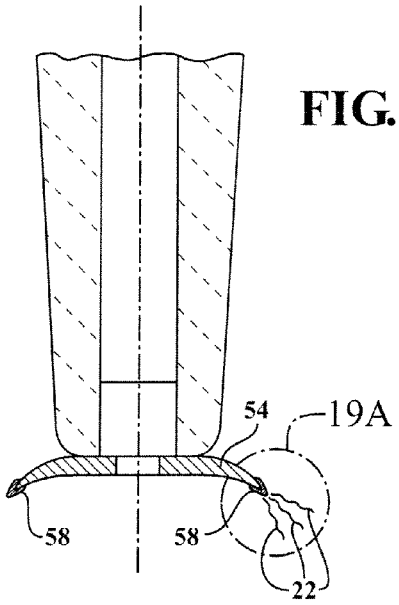
FIG. 19 cross-sectional view of a portion of the igniter of FIG. 18 after use in an internal combustion engine.
Figure 19A:
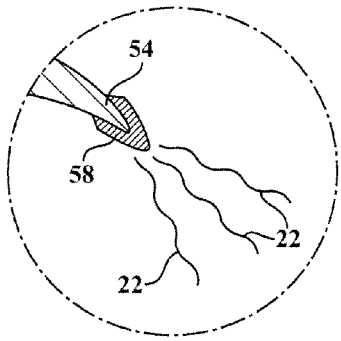
FIG. 19A is an enlarged view of the corona enhancing tip of FIG. 19 along an x-axis.
Figure 19B:
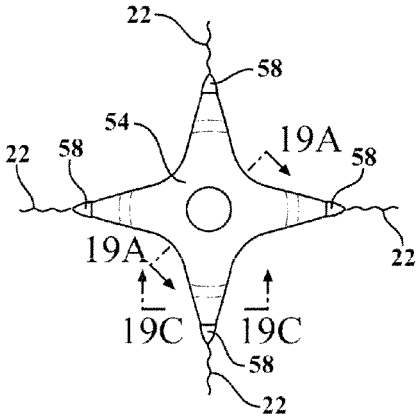
FIG. 19B is a bottom view of the corona enhancing tip of FIG. 19.
Figure 19C:
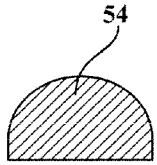
FIG. 19C is a cross-sectional side view taken along line 19C of FIG. 19B.
Figure 20:
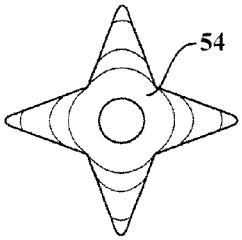
FIG. 20 illustrates a plurality of radii of a base member increasing due to erosion and corrosion.
Figure 21:
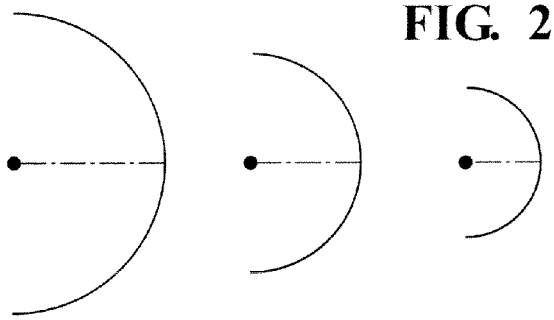
FIG. 21 illustrates a plurality of radii of another base member increasing due to erosion and corrosion.
Figure 22:
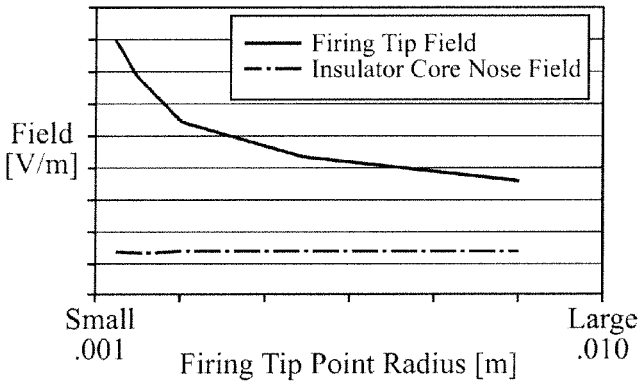
FIG. 22 is a graph showing a relationship between a spherical radius of a corona enhancing tip and electric field strength of a corona emitted from the corona enhancing tip.

In the embodiment shown in FIGS. 18, 18A, and 18B, wherein the distal ends 64 are tapered, the powder metal can be deposited partially on the arcing surface 68 and partially on the firing surface 66 of the branches 60, and then machined to present a sharp spherical radius at the outermost radial point 56 of the corona enhancing tip 52. In one embodiment, the sintered mass presents a spherical radius of not greater than 0.08 millimeters. FIGS. 19, 19A, and 19B illustrate the spherical radius of the emitting member 58 of FIGS. 18, 18A, and 18B experiences little to no change after use in the internal combustion engine.

Figure 5:
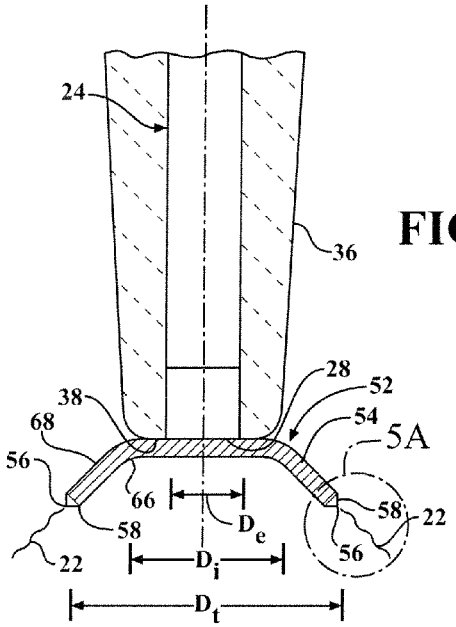
FIG. 5 is a cross-sectional view the igniter of FIG. 4 after use in an internal combustion engine.
Figure 5A:
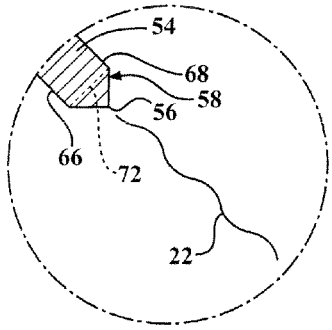
FIG. 5A is an enlarged view of the corona enhancing tip of FIG. 5 along an x-axis.
Figure 5B:
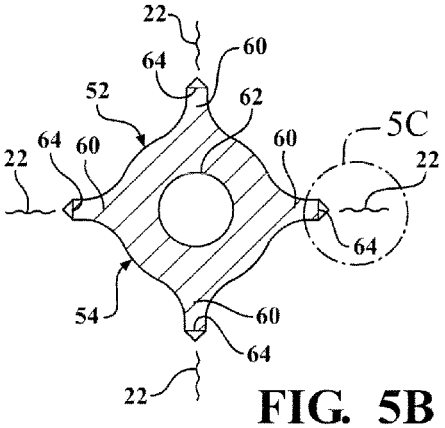
FIG. 5B is a bottom view of the corona enhancing tip of FIG. 5.
Figure 5C:
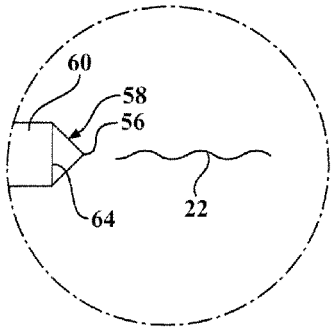
FIG. 5C is an enlarged view of the corona enhancing tip of FIG. 5 along a y-axis.
Figure 11:
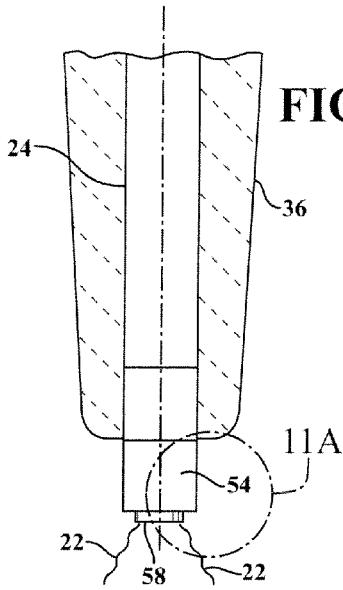
FIG. 11 is a cross-sectional view of the igniter of FIG. 10 after use in an internal combustion engine.
Figure 11A:
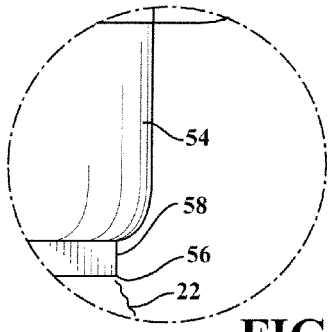
FIG. 11A is an enlarged view of the corona enhancing tip of FIG. 11 along an x-axis.
Figure 11B:
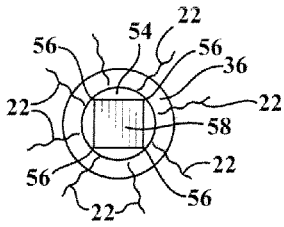
FIG. 11B is a bottom view of the corona enhancing tip of FIG. 11.
Figure 16:
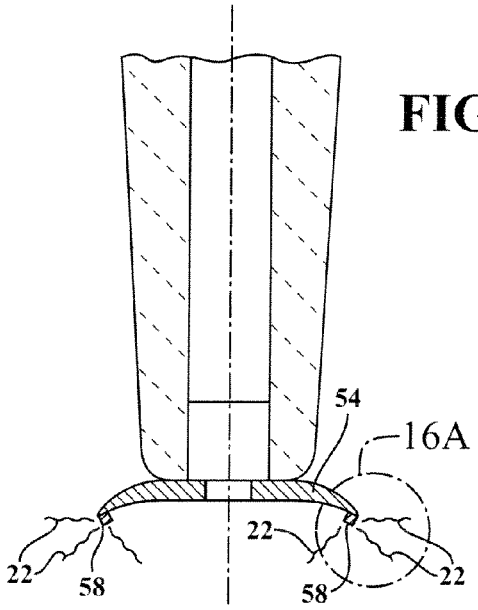
FIG. 16 is a cross-sectional view of a portion of an igniter including a corona enhancing tip in accordance with another embodiment the invention before use in an internal combustion engine.
Figure 16A:
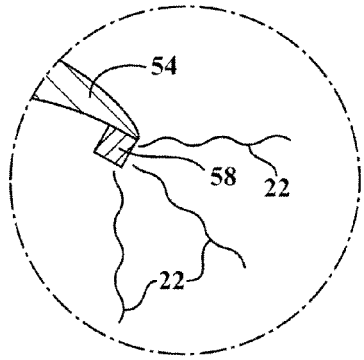
FIG. 16A is an enlarged view of the corona enhancing tip of FIG. 16.
Figure 16B:
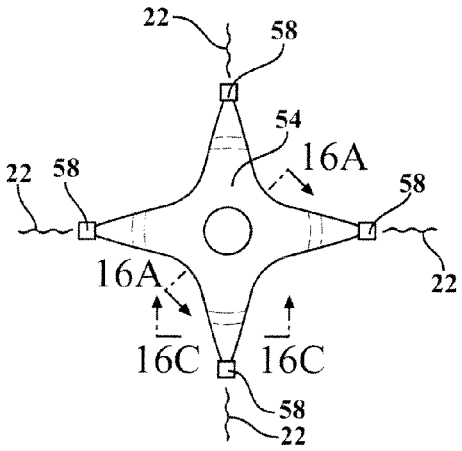
FIG. 16B is a bottom view of the corona enhancing tip of FIG. 16.
Figure 16C:
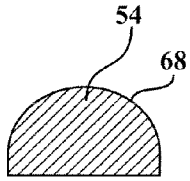
FIG. 16C is a cross-sectional side view taken along line 16C of FIG. 16B.
Figure 17:
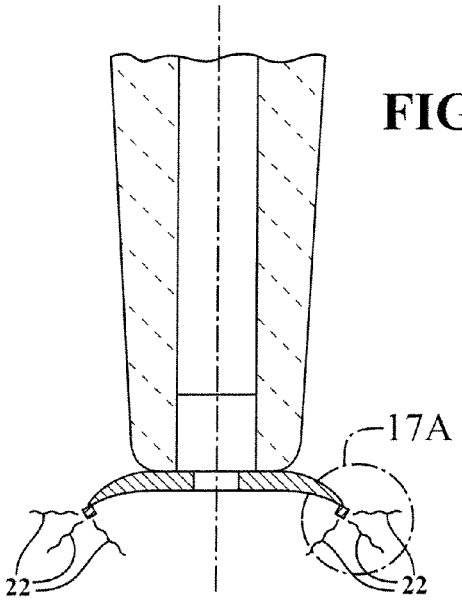
FIG. 17 cross-sectional view of a portion of the igniter of FIG. 16 after use in an internal combustion engine.
Figure 17A:
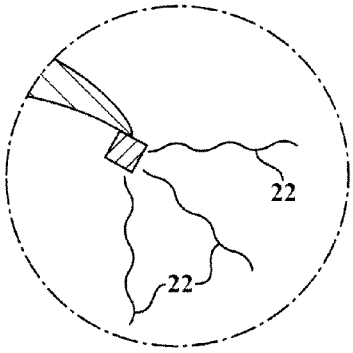
FIG. 17A is an enlarged view of the corona enhancing tip of FIG. 17 along an x-axis.
Figure 17B:
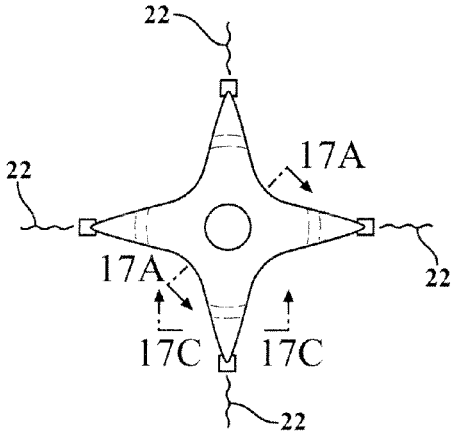
FIG. 17B is a bottom view of the corona enhancing tip of FIG. 17.
Figure 17C:
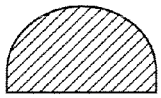
FIG. 17C is a cross-sectional side view taken along line 17C of FIG. 17B.

In the embodiment of FIGS. 5, 10, and 16 the emitting member 58 is provided in a predetermined shape, such as a block, of the volume stable material. The volume stable material can be molded into the predetermined shape, and then disposed on the base member 54, or can be deposited on the base member 54 in the form of powder metal material, sintered, and machined into the predetermined shape. The emitting member 58 in the form of the predetermined shape is preferably disposed at the distal ends 64 of the base member 54 to provide the smallest spherical radius at the outermost radial point 56 of the corona enhancing tip 52. FIGS. 11, 11A, and 11B, illustrate the spherical radius of the emitting member 58 of FIGS. 10, 10A, and 10B experiences little to no change after use in the internal combustion engine, and FIGS. 17, 17A, and 17B, illustrate the spherical radius at the outermost radial point 56 of the emitting member 58 of FIGS. 16, 16A, and 16B experiences little to no change after use in the internal combustion engine.

The igniter 20 of the present invention provides a consistently strong electrical field strength over time during use of the igniter 20 in an internal combustion engine. Even when the inventive igniter 20 and the conventional igniter are initially formed to provide the same spherical radius at the outermost radial point 56, shortly after using the igniters 20 in the internal combustion engine, the inventive igniter 20 provides a stronger electrical field than the conventional igniter. Thus, the igniter 20 of the invention provides a higher quality ignition than the conventional igniter. The igniter 20 is also cost effective since only a small portion needs to be unified of the volume stable material, such as the precious metal.

In addition, the igniter 20 of the present invention emits a greater electrical field strength than the conventional igniter at the same voltage. For example, the inventive igniter 20 emits a stronger electrical field at 30 volts than the conventional igniter emits at 50 volts. Thus, the igniter 20 of the present invention provides significant energy savings relative to the conventional igniter.

Obviously, many modifications and variations of the present invention are possible in light of the above teachings and may be practiced otherwise than as specifically described while within the scope of the appended claims. In addition, the reference numerals in the claims are merely for convenience and are not to be read in any way as limiting.

ELEMENT LIST

| Element Symbol | Element Name |
|---|---|
| 20 | igniter |
| 22 | streamers |
| 24 | electrode |
| 26 | body portion |
| 28 | electrode firing end |
| 30 | electrode terminal end |
| 32 | bulk portion |
| 34 | core |
| 36 | insulator |
| 38 | insulator nose end |
| 40 | insulator upper end |
| 42 | terminal |
| 44 | shell |
| 46 | lower shell end |
| 48 | upper shell end |
| 50 | flanges |
| 52 | corona enhancing tip |
| 54 | base member |
| 56 | outermost radial point |
| 58 | emitting member |
| 60 | branches |
| 62 | platform |
| 64 | distal ends |
| 66 | firing surface |
| 68 | arcing surface |
| 70 | arcing |
| 72 | transition surface |
| $D_e$ | electrode diameter |
| $D_i$ | insulator diameter |
| $D_t$ | tip diameter |
| $d_{tip}$ | tip distance |

The invention claimed is:

1. An igniter for receiving a voltage from a power source and emitting an electrical field to ionize a mixture of fuel and air of an internal combustion engine comprising:

an electrode having a electrode firing end and including a corona enhancing tip at said electrode firing end;

said corona enhancing tip including a base member having a first volume and formed of a base material having a first electrical erosion rate and a first corrosion rate;

said corona enhancing tip including an emitting member disposed on said base member;

said emitting member having a second volume being less than said first volume;

said emitting member being formed of a volume stable material having a second electrical erosion rate being less than said first electrical erosion rate and a second corrosion rate being less than said first corrosion rate.

2. An igniter as set forth in claim 1 wherein said corona enhancing tip includes an outer surface being exposed and presenting spherical radii; and wherein the smallest spherical radius of said corona enhancing tip is at an outermost radial point of said outer surface.

3. An igniter as set forth in claim 1 wherein said emitting member is a wire.

4. An igniter as set forth in claim 3 wherein said wire extends between wire ends and is tapered to at least one of said wire ends.

5. An igniter as set forth in claim 1 wherein said emitting member is a layer disposed along said base member.

6. An igniter as set forth in claim 1 wherein said volume stable material of said emitting member is a sintered powder metal and said emitting member is disposed on a portion of said base member.

7. An igniter as set forth in claim 1 wherein said base member and said emitting member each include an outer surface being exposed and present spherical radii at said exposed outer surface; and wherein at least one of said spherical radii at said exposed outer surface of said emitting member is less than each spherical radii at said exposed outer surface of said base member.

8. An igniter as set forth in claim 7 wherein said spherical radii of said emitting member increases at a lower rate than each of said spherical radii of said base member during use of the igniter.

9. An igniter as set forth in claim 7 wherein said spherical radii at said exposed outer surface of said emitting member is not greater than 0.2 millimeters.

10. An igniter as set forth in claim 1 wherein said second volume of said emitting member decreases at a lower rate than said first volume of said base member during use of the igniter.

11. An igniter as set forth in claim 1 wherein said materials of said corona enhancing tip each have a melting temperature and wherein said melting temperature of said volume stable material is greater than said melting temperature of said base material.

12. An igniter as set forth in claim 1 wherein said volume stable material is selected from the group consisting of: platinum, platinum alloys, iridium, and iridium alloys.

13. An igniter as set forth in claim 1 wherein said base material is selected from the group consisting of: nickel, nickel alloys, copper, copper alloys, iron, and iron alloy.

14. An igniter as set forth in claim 1 wherein said base member includes a platform and a plurality of branches extending outwardly and downwardly from said platform to distal ends and wherein said emitting member is disposed at said distal ends.

15. An igniter as set forth in claim 14 wherein said branches of said base member are tapered to said distal ends.

16. An igniter as set forth in claim 14 wherein said branches of said base member include a firing surface facing outwardly and an oppositely facing arcing surface and wherein said emitting member is disposed on said firing surface.

17. An igniter as set forth in claim 16 wherein said arcing surface is convex.

18. An igniter as set forth in claim 14 wherein said branches of base member include a firing surface facing outwardly and an oppositely facing arcing surface and a transition surface interconnecting said firing surface and said arcing surface at said distal ends; and wherein said emitting member is a sintered powder of said volume stable material disposed on said transition surface.

19. An igniter as set forth in claim 1 wherein said electrode includes a body portion extending longitudinally from an electrode terminal end to said electrode firing end; and including an insulator surrounding and extending longitudinally along said body portion from a insulator nose end adjacent said electrode firing end to an insulator upper end;

said insulator having an insulator diameter at said insulator nose end extending generally perpendicular to said longitudinal body portion of said electrode;

said corona enhancing tip being disposed at said electrode firing end and outwardly of said insulator nose end;

said corona enhancing tip having a tip diameter extending generally perpendicular to said longitudinal body portion of said electrode; and said tip diameter being greater than said insulator diameter.

20. An igniter as set forth in claim 1 wherein said electrode includes a body portion extending longitudinally from an electrode terminal end to said electrode firing end;

said body portion has an electrode diameter extending generally perpendicular to said longitudinal body portion;

said corona enhancing tip has a tip diameter extending generally perpendicular to said longitudinal body portion; and said tip diameter is greater than said insulator diameter.

21. An igniter for receiving a voltage from a power source and emitting an electrical field that forms a corona to ionize a mixture of fuel and air of an internal combustion engine comprising:

an electrode extending longitudinally from a electrode firing end to a electrode terminal end;

an insulator surrounding and extending longitudinally along said body portion from an insulator nose end adjacent said electrode firing end to an insulator upper end;

said insulator having an insulator diameter at said insulator nose end extending generally perpendicular to said longitudinal body portion of said electrode;

a terminal received in said insulator and in electrical communication with said electrode terminal end;

a shell formed of a metal material surrounding and extending longitudinally along a portion of said insulator from a lower shell end to an upper shell end such that said insulator nose end projects outwardly of said lower shell end;

said shell including external flanges extending outwardly between said shell ends;

said electrode including a corona enhancing tip at said electrode firing end and outwardly of said insulator nose end;

said corona enhancing tip having a tip diameter extending generally perpendicular to said longitudinal body portion of said electrode;

said tip diameter being greater than said insulator diameter;

said corona enhancing tip including a base member having a first volume and formed of a base material having a first electrical erosion rate and a first corrosion rate;

said corona enhancing tip including an emitting member disposed on said base member;

said emitting member having a second volume being less than said first volume;

said emitting member being formed of a volume stable material having a second electrical erosion rate being less than said first electrical erosion rate and a second corrosion rate being less than said first corrosion rate, whereby said terminal receives a voltage and conveys the voltage to said electrode so that said emitting member emits an electric field to ionize a mixture of fuel and air.

22. A method of forming an igniter for receiving a voltage from a power source and emitting an electrical field to ionize a mixture of fuel and air of an internal combustion engine comprising the steps of:

providing a base member of a base material having a first electrical erosion rate and a first corrosion rate and a first volume;

disposing an emitting member formed of a volume stable material having a second electrical erosion rate less than said first electrical erosion rate and a second corrosion rate less than said first corrosion rate and a second volume being less than said first volume on the base member.

23. A method as set forth in claim 22 including forming the emitting member into a wire before disposing the emitting member on the base member.

24. A method as set forth in claim 22 wherein said disposing the emitting member on the base member includes depositing the volume stable material in the form of powder.

25. A method as set forth in claim 22 wherein said disposing the emitting member on the base member includes applying a layer of the volume stable material.

26. A method as set forth in claim 22 wherein said forming the base member includes stamping a shape comprising plurality of branches extending outwardly from a platform to distal ends from a sheet of the base material; and bending the branches to a predetermined angle relative to the platform.

27. A method as set forth in claim 26 including tapering the branches to the distal ends.

28. A method as set forth in claim 22 wherein said disposing the emitting member on the base member includes laser sintering.

29. A method as set forth in claim 22 including forming an outermost radial point of an outer surface of the corona enhancing tip to present a spherical radius being the smallest spherical radius of the corona enhancing tip.

* * * * *